US005473997A

United States Patent [19]

Solomon et al.

[11] Patent Number: 5,473,997

[45] Date of Patent: Dec. 12, 1995

[54] OVERBED TABLE WITH SINGLE BAR CANTILEVER SUPPORT

[75] Inventors: Robert A. Solomon, Kalamazoo; Richard L. Lenger, Kentwood, both of Mich.

[73] Assignee: Am Fab, Inc., Kalamazoo, Mich.

[21] Appl. No.: 118,930

[22] Filed: Sep. 9, 1993

[51] Int. Cl.[6] ..... A47B 57/00

[52] U.S. Cl. ..... 108/93; 108/49; 312/249.11

[58] Field of Search ..... 108/93, 108, 94, 108/95, 106, 49, 103, 105; 312/249.8, 249.11, 334.26; 248/131

[56] References Cited

U.S. PATENT DOCUMENTS

| | | | |
|---|---|---|---|
| 1,653,657 | 12/1927 | Pretsch | 108/49 X |
| 2,749,197 | 6/1956 | Smith | 108/49 X |
| 3,094,949 | 6/1963 | Oom | 108/94 X |
| 3,908,565 | 9/1975 | Burnett | 108/94 X |
| 4,715,295 | 12/1987 | Hartman et al. . | |
| 5,016,846 | 5/1991 | Solomon . | |
| 5,106,043 | 4/1992 | Solomon . | |

*Primary Examiner*—José V. Chen

*Attorney, Agent, or Firm*—Price, Heneveld, Cooper, DeWitt & Litton

[57] ABSTRACT

An overbed table having a supporting base, an adjustable vertical column on the base and a table top supported by a cantilever mourned support brace mounted between the vertical column and the end of the supported table top. The table top can have a slidable vanity drawer mounted on the bottom of the table top. A second table top can be pivotally mounted under the table top. The table can also have a double table top. The double table top has spaced frictional driving wheels which cooperate with configured edges on a pair of vertically stacked table tops. One table top is operatively positioned between the driving wheels, while the second table top is operatively coupled to the outside surface of the driving wheels. Motion by either table top in a first direction will cause the other table top to move in the opposite direction. A vanity drawer can be mounted under the lower table top.

22 Claims, 5 Drawing Sheets

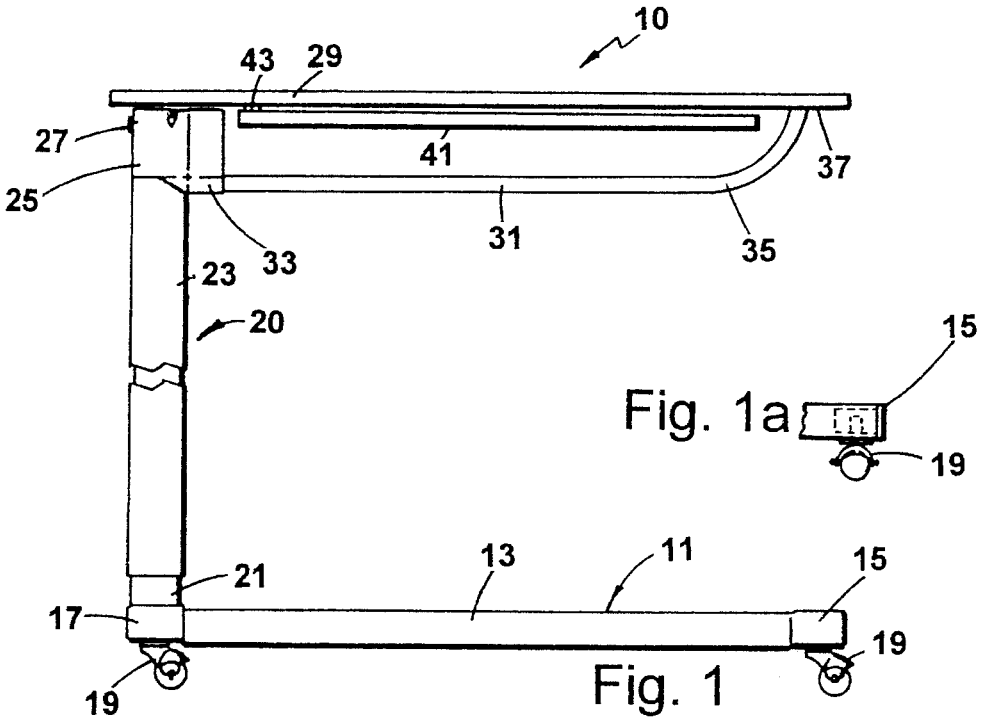
Fig. 1a
Fig. 1
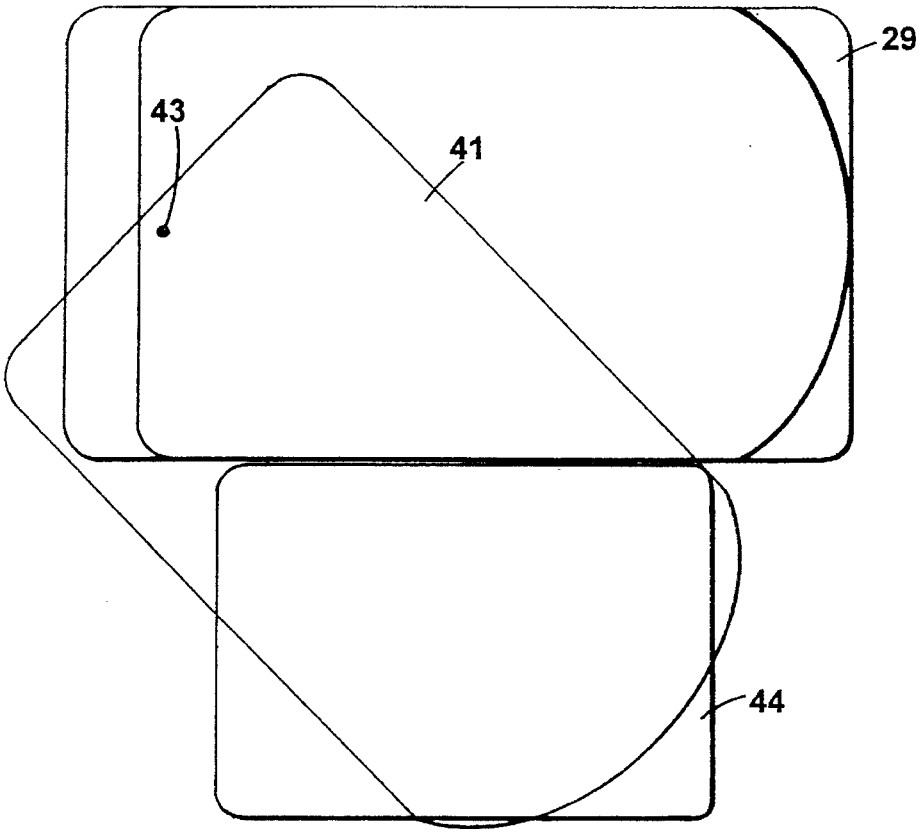
Fig. 2

127
129
131

111
113
115

117
125
79"
75
69'
119
117
121
123
73"

75
73'
77
79'
103
101
107
105
69
61
63
25
31
33

OVERBED TABLE WITH SINGLE BAR CANTILEVER SUPPORT

BACKGROUND OF THE INVENTION

The present invention relates to the field of overbed tables.

Overbed tables are commonly used in hospitals, nursing homes and the like, to provide a convenient surface on which the patient may store personal items and medical personnel may set wash basins, assorted medicines and bandaging materials used in treatment. The conventional overbed table has a floor mounted stand supported by casters. An adjustable vertical post is positioned at one end of the floor stand and a table top is mounted on the top of the post. A locking mechanism is included within the post to enable the table top to be raised and lowered and fixed at a desired height.

While the table is referred to as an overbed table, it is not so limited. The table can also be moved about the room and positioned in front of or next to a chair for ease of access by a patient.

The conventional overbed table has a single surface upon which all of the above mentioned items can be placed. This frequently causes problems when personal items are on the top of the table and it is necessary to find space for a large item, such as a food tray. In order to help solve this problem, an overbed table is disclosed in U.S. Pat. No. 4,715,295 issued Dec. 29, 1987, which has two vertically stacked tops. The upper surface can be used to conveniently store personal items, medicines and the like, while the lower surface can be moved away from the upper surface to provide a clear surface for supporting a food tray. While this overbed table is a substantial improvement over the table having only a single top, it does have the disadvantage of having a large heavy frame for supporting the two table tops and the necessary slide mechanisms to provide for movement of both the table tops. The resulting substantial weight makes it difficult to adjust the height of the table relative to the patient and the complex mechanism for moving one table top relative to the other presents both a mechanical and a sanitary problem. The springs, levers, slide tracks and the like present fertile areas for dirt to collect which are difficult to clean.

SUMMARY OF THE INVENTION

In accordance with the present invention, an improved overbed table is provided which can have either a single top or a double top. The table top is supported at one end by a vertical post and, at the opposite end, by a cantilever support brace which extends from the vertical post out to the remote end of the table top. Since only a single cantilever support is used for the table top, a substantial amount of weight is removed from the supporting frame. The reduction in weight make the table much easier to adjust and also to clean. In a preferred embodiment of the overbed table, a bidirectional double table top is provided having a simple frictional drive mechanism which enables the vertically spaced table tops to move in opposite directions.

These and other advantages, purposes and features of the invention will become more apparent from a study of the following description taken in conjunction with the drawings described below.

BRIEF DESCRIPTION OF THE DRAWINGS

FIG. 1 is an elevational view of an overbed table having a cantilever supported top surface with a pivotally mounted second table top under the first table top;

FIG. 1A is a fragmentary end view of one end of the base for supporting the overbed table shown in FIG. 1;

FIG. 2 is a plan view showing the pivotally mounted table top of FIG. 1 moved out from the storage position to the use position with a schematic representation of a food tray supported on the pivotally mounted table top;

DETAILED DESCRIPTION OF THE PREFERRED EMBODIMENTS

Figure 3:
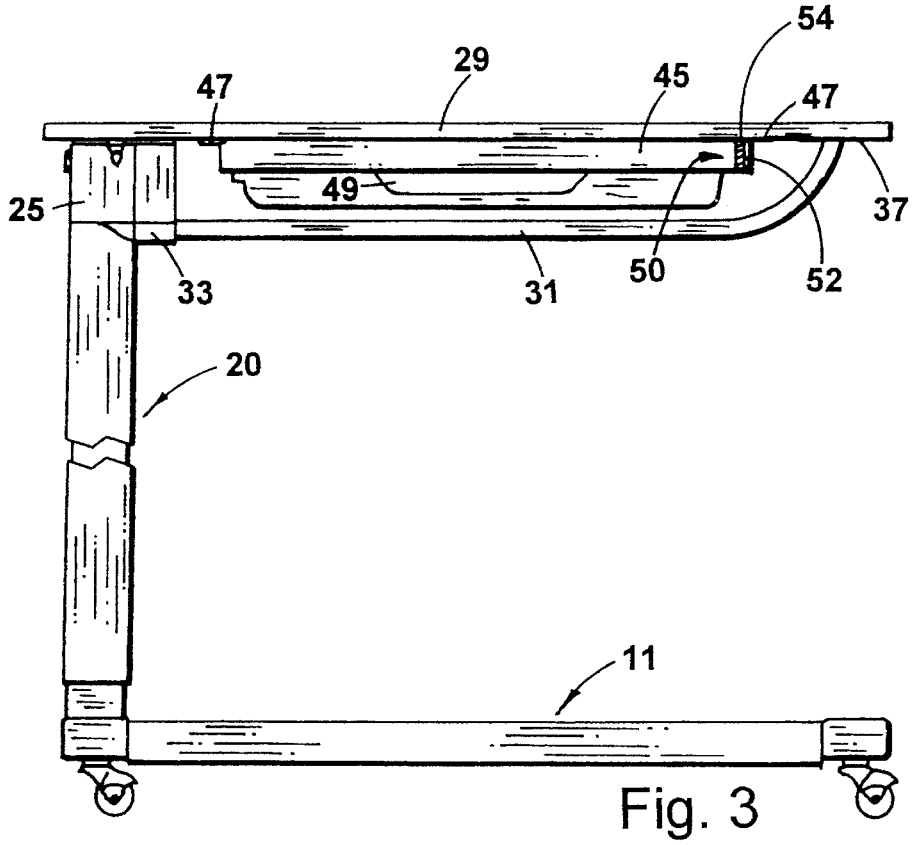
FIG. 3 is an elevational view of an overbed table showing a slidably mounted vanity drawer attached to the bottom of the cantilever supported table top.

Referring to FIG. 1, the overbed table 10 has a base 11 which includes one elongated member 13, and a pair of perpendicularly oriented end members 15 and 17 attached to the ends of side member 13 in an H-shaped arrangement. It is contemplated that members 13, 15 and 17 can be arranged in different arrangements to form a stable base such as a "U" shape or other shapes. Nylon end plugs 18 (FIG. 1A) are positioned in the ends of end members 15 and 17. Caster assemblies 19 include an upwardly extending post that extends upwardly press-fittingly into end plugs 18 to support the base member and enable it to be freely moved about a floor surface.

Substantially centrally disposed on the top of cross member 17 is a vertically adjustable column 20 which has an inner tubular member 21 over which an outer tubular member 23 can be adjustably moved. Tubular member 23 can be raised and lowered vertically on tubular member 21 and a locking mechanism can be used to hold tubular member 23 in position. A suitable locking mechanism is disclosed in U.S. Pat. Nos. 5,016,846 issued May 21, 1991 and 5,106,043 issued Apr. 21, 1992, both of which are assigned to the same assignee as the present application and are incorporated herein by reference. A top bracket 25 is attached to the remote end of outer tubular member 23 by spaced bolts 27, only one of which is shown in FIG. 1.

A table top 29 is fastened to top bracket 25 by screws (not shown). Table top 29 extends outwardly from the outer tubular member 23 of vertically adjustable column 20 and top bracket 25 in a cantilever fashion. A cantilever brace member 31 is attached to top bracket 25 and is preferably inserted into a sleeve portion 33 which holds brace member 31 in place and provides support. The cantilever brace member 31 shown has rounded corners (FIG. 9), but it is contemplated that other shapes such as a rectangular shape can also be used. Cantilever support member 31 extends outwardly over base member 11 and then curves upwardly at curved portion 35 to attach to a mounting flange 37 on the bottom, near the end, of table top 29. A single cantilever brace is used to support the table top reducing the mass of the previously used frames.

Referring now to FIGS. 1 and 2, a second table top 41 is pivotally mounted by a pivot member 43 attached to the bottom of table top 29. Pivot member 43 can be a bolt or screw which is threaded into the bottom of table top 29 with a suitable metal or plastic sleeve inserted into the top 41. Table top 41 can be stored under table top 29 until needed, for example, when a food tray 44 is to be served to a patient. Pivotally mounted table top 41 can then be swung out in either direction from the storage position under table top 29 to a use position, as shown in FIG. 2, where food tray 44 can be supported without disturbing the personal items, medicines, and the like, located on the top of table top 29. Through the use of pivotally mounted table top 41, the patient always has a clear surface for use in supporting a food tray, medicines, or the like, when needed. When the food tray has been removed, the table top can again be returned to the storage position under table top 29. Table top 41 can be retained in a given position relative to table top 29 by a detent or locking mechanism positioned proximate or spaced from pivot member 43.

In the event a patient would prefer to have additional storage for personal items rather than a second pivotally mounted table top, a slidably mounted vanity drawer 45 (FIG. 3) can be supported on island drawer guides 47 which are attached to the bottom of table top 29. The island drawer guides enable the vanity drawer to extend from either side of the table. A patient can grasp an indented handle 49 in order to draw the vanity drawer out from under the table. A ball detent mechanism 50, including a spring 52 and supported ball 54, interact with a recess 52 in the bottom of table top 29 to keep the vanity drawer 45 in the stored position underneath the table top.

It can be seen in FIGS. 1 and 3 that cantilever support brace 31 forms a flattened U-shaped configuration with one end of the support beam being attached at 33 to top bracket 25 with the cantilever support brace 31 extending outwardly below vanity drawer 45 and then upwardly to flange 37 on the remote end of table top 29.

Figure 9:
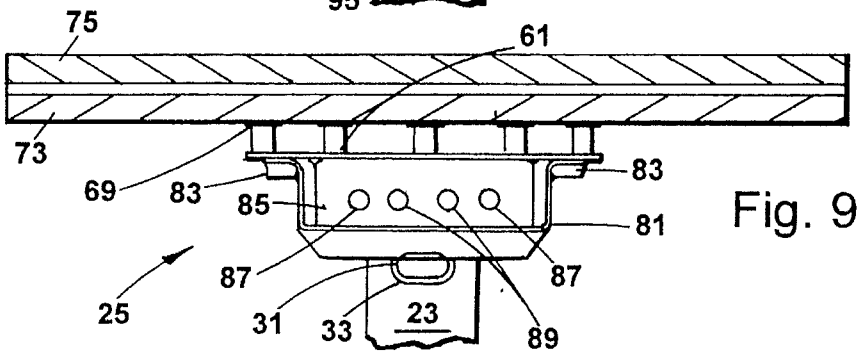
FIG. 9 is a sectional view taken along the line IX—IX of FIG. 7.

Cantilever support brace 31 is preferably made of a compressed tubular configuration, as shown in the sectional view of FIG. 9. The use of a tubular member substantially reduces the weight of the support brace while still providing high strength. While an oval shape is preferred for the support brace, round, square or other configurations of tubes can be used, as well as lightweight solid metal structures. The tubular member is preferred in view of its strength-to-weight ratio and in view of the ease with which it can be cleaned.

Figure 4:
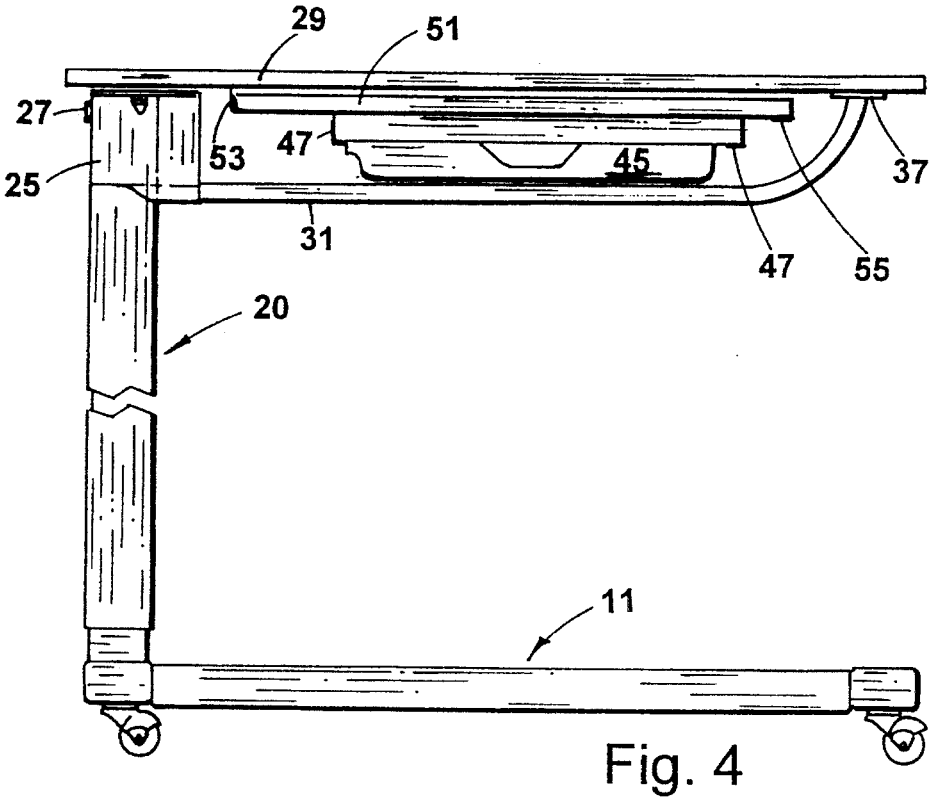
FIG. 4 is an elevational view showing a vanity drawer mounted on the bottom of a slidably mounted second table top which is attached to the bottom of the cantilever supported table top.

In a further embodiment of the overbed table, as shown in FIG. 4, an additional table top 51 is slidably mounted to brackets 53 and 55 attached to the bottom of upper table top 29. Island drawer guides can be used to support table top 51 so that it can be moved in either direction from under table top 29. Table top 51 can be slid directly out from under the table toward the patient to provide a clean surface for food trays and the like. A vanity drawer 45 is slidably attached by island drawer guides 47 attached to the bottom of lower table top 51. As in the other embodiments of the overbed table, cantilever support brace 31 extends from top bracket 25 of vertical column 20, out to flange 37 attached to the bottom of the remote end of table top 29. Again, a substantially lighter support frame is provided through the use of cantilever support brace 31 which enables the overbed table to be equipped not only with a second table top 51, but also with a vanity drawer 45.

Figure 5:
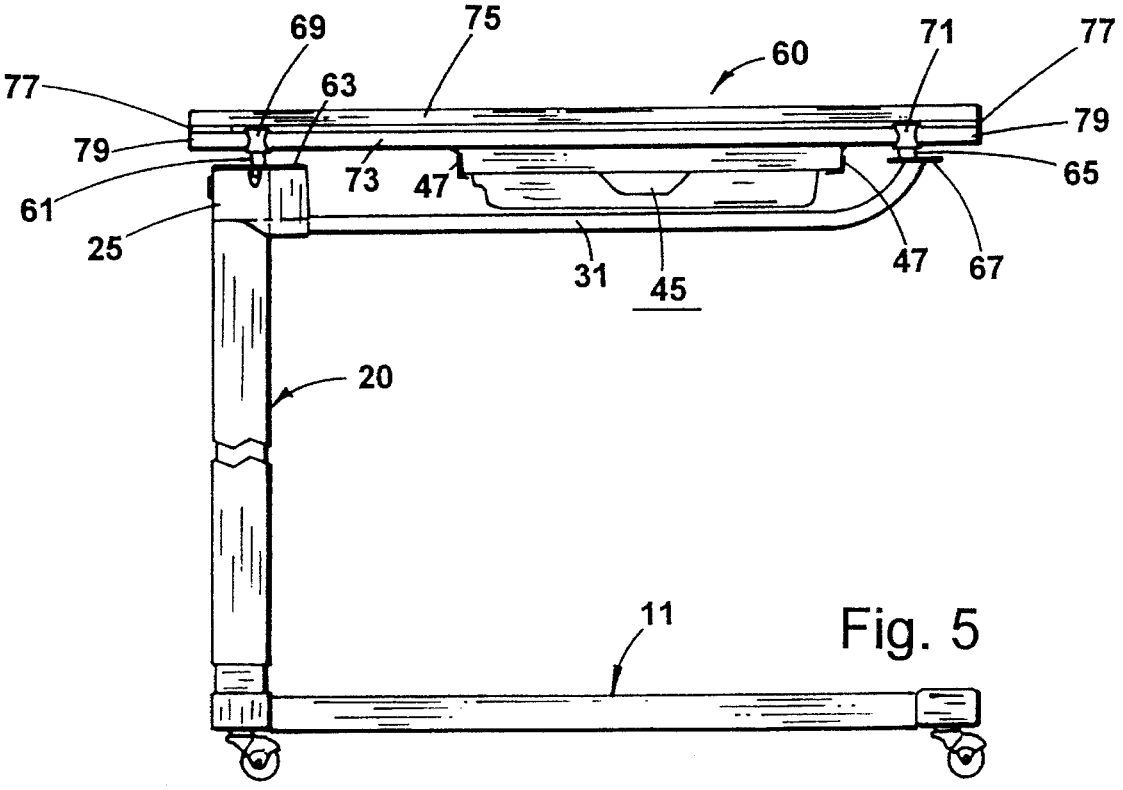
FIG. 5 is an elevational view of an overbed table having a cantilever supported double table top.

Another embodiment of the present invention, as shown in FIG. 5, employs the same base 11, adjustable vertical column 20 and top bracket 25 on the adjustable vertical column and cantilever support brace 31. A double table top 60 is mounted on the top of the vertical adjustable column and the remote end of the cantilever support brace.

Figure 6:
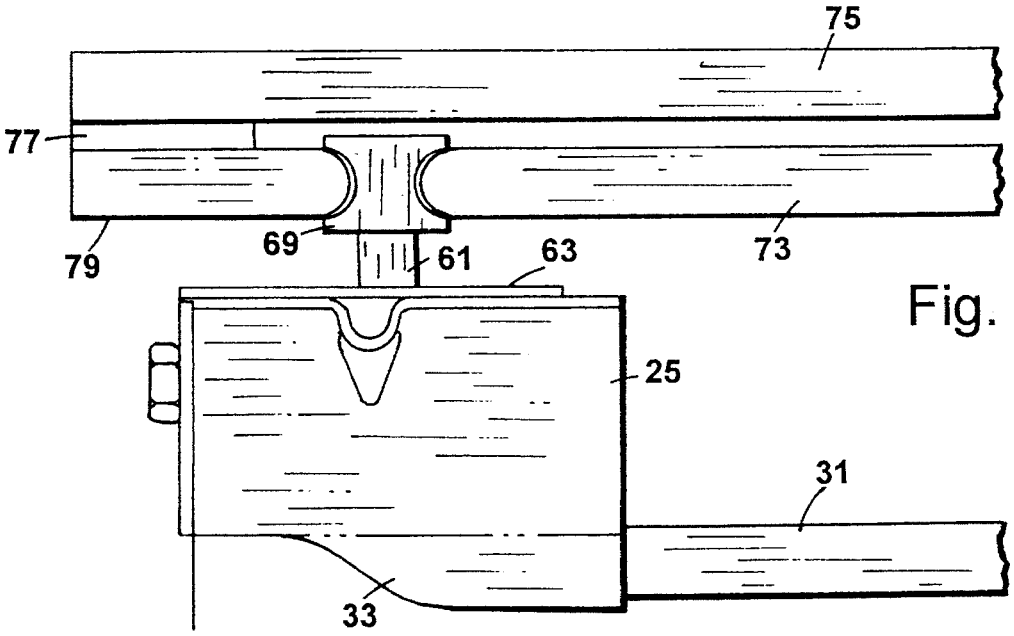
FIG. 6 is an enlarged view of one end of the double table top.
Figure 7:
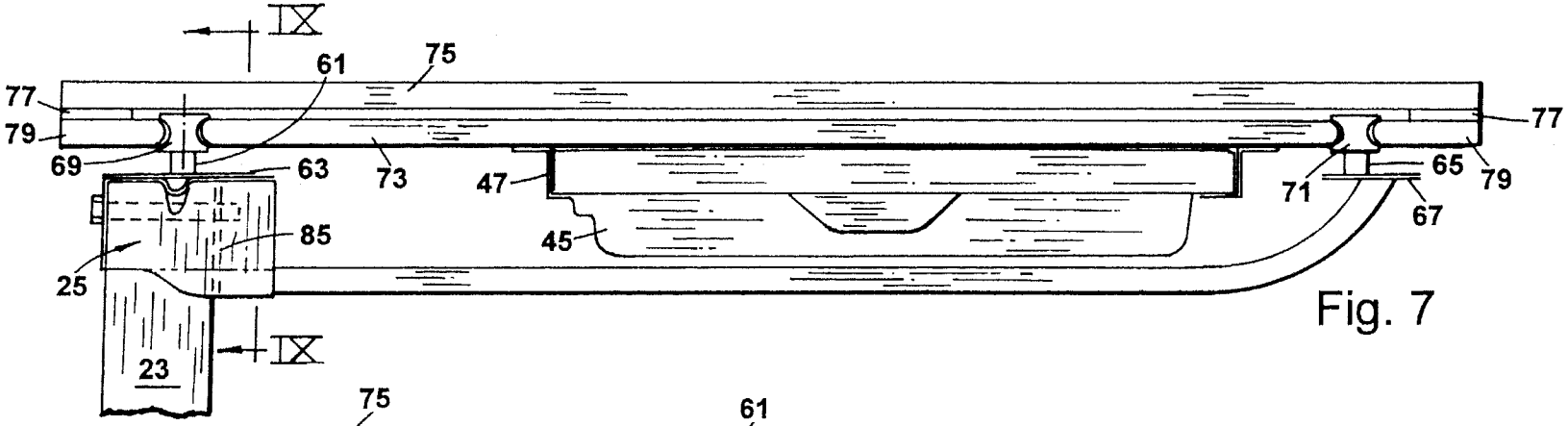
FIG. 7 is an enlarged view of the cantilever supported double table top having a vanity drawer slidably attached to the bottom of the lower table top.

As shown in FIGS. 6–9, spaced vertical axles 61 are mounted on a flange 63 on the upper surface of top bracket 25. A similar grouping of spaced vertical axles 65 are provided on a flange 67 which is mounted on the distal end of cantilever support brace 31. The flanges 63 and 67 are of substantially rectangular configuration and provide spaced parallel support members for vertical axles 61 and 65. The vertical axles can be welded to the flanges. A driving wheel 69 is mounted on the top of each of the vertical axles 61. A similar driving wheel 71 is mounted on each of the vertical axles 65. As shown in FIGS. 5, 6 and 7, each of driving wheels 69 and 71 has a curved circumferential groove about the surface of the wheel. The wheels can be made of metal or plastic and can be coated or covered with a rubber or other plastic material of similar properties to provide a surface with increased friction. The surfaces of the drive wheels should also be resilient to enable them to flex slightly as they grip against tile drive members.

A first table top 73 is supported at each end by driving wheels 69 and 71. A second table top 75 overlies the first table top and the driving wheels. A pair of spacers 77 is attached at the bottom at each end of table top 75. A pair of driven members 79 is attached to spacers 77. Driven members 79 extend inwardly from the opposite ends of table top 75. Each of the driven members has a rounded surface which is configured to interact with the recessed curved surface on each of the driving wheels 69 and 71. Each of the table tops 73 and 75 is supported by opposite sides of driving wheels 69 and 71. With this arrangement, if either table top 73 or 75 is moved in a first direction, for example, into the paper as shown in FIG. 5, the opposite table top will be frictionally driven by the drive wheels out of the paper. The double-acting table top provides an available clean surface for the patient to receive a food tray or the like. When the patient wishes to gain access to lower table top 73, he or she merely pushes against upper table top 75 causing it to roll away from the patient while lower table top 73 approaches the patient. The patient can stop moving table 75 when enough of table top 73 is extended toward the patient to support whatever it is the patient wishes to set on tile table. A detent or locking mechanism (not shown) can be attached to the lower table top 73 such as on driving wheels 69 and 71 and/or on the mating surfaces on members 73 and 79 to retain table top 73 in the desired position relative to upper table top 75. It is contemplated that a number of different locking mechanisms can be used, such as ball-and-sockettype detents or friction lock mechanisms.

A substantial improvement is gained through the use of the frictional driving wheels to move the stacked table tops. The mechanism is much easier to keep clean which is very important in a health care facility. No tracks and linkages are used which are fertile areas for collecting dirt and bacteria. The frictional surfaces of the drive wheels are relatively smooth so that they do not tend to pick up dirt.

In illustrating the double table top, driving wheels having recessed surfaces are shown with convex curved ends on the table top and driven members. It is obvious that the curve on the driving wheels can be convex and the ends of the table tops and driven members could have a recessed or concave surface. Likewise, other complementary surface configurations for the driving wheels and table tops can be used. It is preferred that the surface of the driving wheels and the edges of the table tops and driven members be configured to support the table tops as well as drive the table tops. It is clearly within the scope of the present invention to have separate support members for the table tops while still using the frictional driving wheels.

As discussed in relation to the embodiments of the overbed table with a fixed table top, a vanity drawer 45 can be supported underneath the lower table top by drawer guides 47 which enable the vanity drawer to be stored underneath the stacked tops and drawn out when needed. Referring to the top 73 in FIGS. 5 and 7, a vanity drawer 45 can be similarly mounted to the bottom of table top 73 using island drawer guides.

Figure 8:
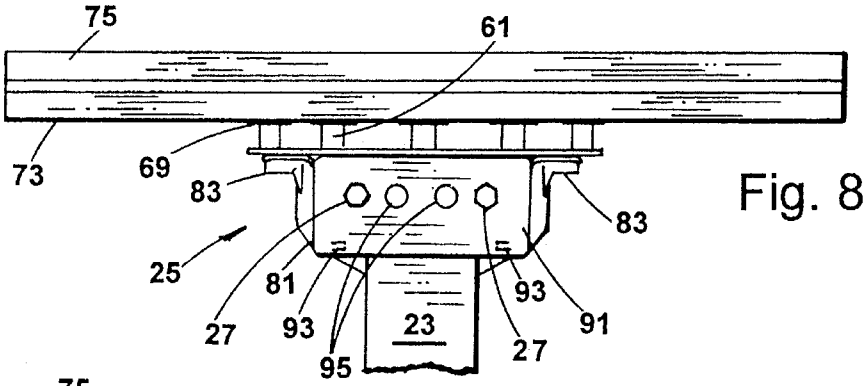
FIG. 8 is an end view of the upper portion of the overbed table and the double table top.

Referring to FIGS. 8 and 9, top bracket 25 has a U-shaped bracket 81 with a pair of outstanding V-shaped ears 83. Ears 83 form a saddle for supporting the actuating bracket for the locking mechanism for the vertical adjustable column. A fixed plate 85 (FIG. 7 and 9) is attached to member 81, preferably by welding. A pair of threaded or tapped apertures 87 are provided in the fixed plate 85 along with a pair of indented portions 89 which fit within a pair of apertures in column 23 (FIG. 8) to locate the top bracket on adjustable vertical tube 23. A separate plate 91 (FIG. 8) has a pair of fingernails or inwardly depending flaps 93 for holding plate 91 in position. A pair of indented portions 95 is provided for insertion into apertures on the opposite sides of column 23 from the similar indented portions 89. A pair of threaded bolts 27 extends through apertures in plate 91 and is threadably attached to threaded apertures 87 in fixed plate 85 to clamp the top bracket against either side of vertical column member 23. Top bracket 25 is thereby securely fastened to movable vertical column member 23.

Figures 10, 11, 12, 13:
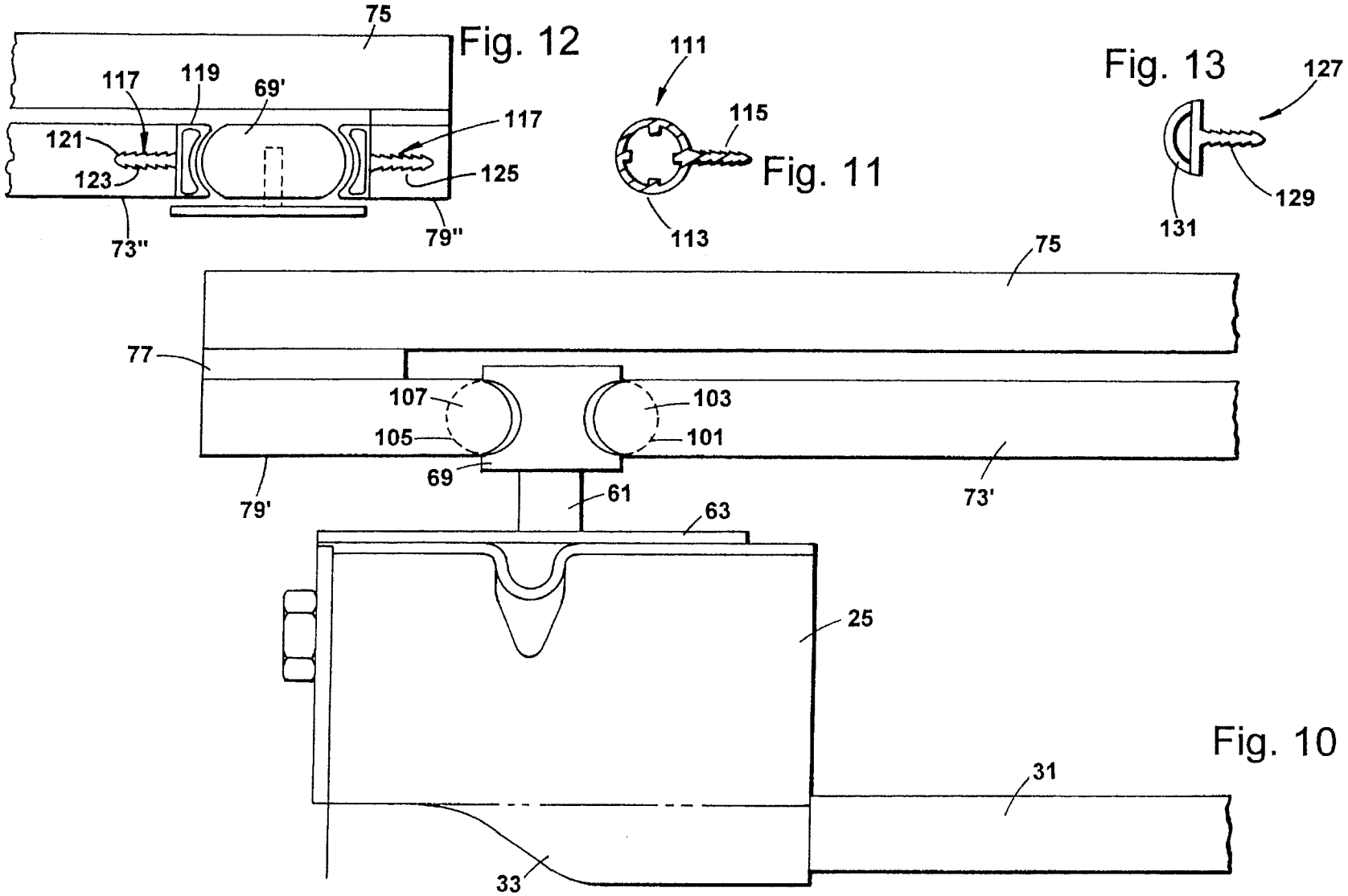
FIG. 10 is an enlarged view of a modified double table top comparable to the table top shown in FIG. 6, but having a modified wheel engaging edging member on the lower table top and related driven member.
FIG. 11 is a cross sectional view of a second modified edging member.
FIG. 12 is an enlarged view of a third modified wheel engaging edging member on the lower table top and the related wheel and driven member structures.
FIG. 13 is a cross sectional view of a fourth modified edging member.

Another embodiment of lower table top 73 and driven member 79 is illustrate in FIG. 10 by lower table top 73' and driven member 79'. Top 73 includes a semi-circularly shaped channel 101 that extends around its outer edge. A round extruded edging member 103 is positioned in channel 101. Edging member 103 can be a variety of different constructions, as discussed hereinafter, but as shown is a resilient, filled, rubber-band-like extrusion the edge of driven member 79' includes a semi-circularly shaped channel 105 comparable to channel 101, and a round extruded edging member 107 comparable to edging member 103 is positioned in channel 105. Edging member 107 is secured in channel 105 in a number of different ways such as by adhesive or fasteners. As shown in FIG. 10, wheels 69 engage and depress edging members 103 and 107 as they pass across same this has the advantage of giving a smooth table motion and also of frictionally retaining lower table 73' in a selected position.

It is contemplated that several different constructions of edging members 103 and 107 are possible. FIG. 11 shows an edging member 111 having a hollow round wheel-engaging end 113 for engaging wheels 69, and a "Christmas tree" shaped retainer end 115 for retainingly engaging a slot (not shown) at the center of lower table top channel 101 or in driven member channel 105. FIG. 12 shows another edging member 117. In edging member 117, wheels 69' have a convex shape (as opposed to the concave shape of wheels 69). Edging member 117 has a concavely-shaped wheel engaging end 119 and a "Christmas tree" shaped retainer end 121 adapted to frictionally engage a slot 123 in the edge of lower table top 73" (and frictionally engage a comparable slot 125 in driven member 79") notably, the edges of lower table top 73" and driven member 79" do not include a channel or rounded shape, but rather are square and include only slots 123 ad 125. FIG. 13 illustrates yet another edging member 127. Edging member 127 can be used on a lower table top such as top 73" (FIG. 12) and is intended to matingly engage a concavely-shaped wheel such as wheel 69 (FIG. 10). Notably, edging member is an extruded member, but includes a high durometer retaining end 129 and a lower durometer wheel engaging end 131.

It can be seen from the above description that a substantially improved overbed table is provided which has a substantially lighter frame and which can support a single or double top table. The double top table is a substantial improvement over those seen in the art where multiple tracks and linkage assemblies are needed to control the movement of the table tops. The double table top of the present invention uses frictional drive against the edges of the lower table top and the edges of the driven members for the upper table top which eliminates the necessity for linkages and tracks.

Although the invention has been described with respect to specific preferred embodiments thereof, many variations and modifications will become apparent to those skilled in the art. It is, therefore, the intention that the appended claims be interpreted as broadly as possible in view of the prior art to include all such variations and modifications.

The embodiments of the invention in which an exclusive property or privilege is claimed are defined as follows:

1. An overbed table comprising:

a base member;

an adjustable vertical column extending upwardly from one end of said base member;

a table top attached at one end to an adjustable end of said adjustable vertical column and including a remote end extending outwardly therefrom and further including a center section spacing the one end of the table top and the remote end apart; and a cantilever support brace spaced below the one end of the table top and the center section extending outwardly from said adjustable vertical column and upwardly to engage and support the remote end of said table top, said cantilever support brace and said table top defining a centrally located open space therebetween configured to receive a generally horizontally oriented planar member operably centrally mounted under said table top.

2. The overbed table as set forth in claim 1, wherein said cantilever support brace has an elongated first portion spaced below said table top and a second portion extending upwardly to support the remote end of said table top.

3. The overbed table as set forth in claim 1, wherein said base member has an elongated substantially rectangular configuration and said table top overlies said base member.

4. The overbed table as set forth in claim 1, wherein said table top has an elongated substantially rectangular configuration.

5. The overbed table as set forth in claim 1, wherein said cantilever support brace is an L-shaped tubular member attached at one end to said adjustable vertical column at a location spaced below said table top and extends outwardly and upwardly to support the remote end of said table top.

6. The overbed table as set forth in claim 5, wherein said cantilever support brace has an oval cross section and is positioned on said table with a wide surface facing upwardly toward a bottom of said table top.

7. The overbed table comprising:

a base member;

an adjustable vertical column extending upwardly from one end of said base member;

a table top attached at one end to an adjustable end of said adjustable vertical column and including a remote end extending outwardly therefrom;

a cantilever support brace spaced below the one end of the table top extending outwardly from said adjustable vertical column and upwardly to support the remote end of said table top; and a vanity drawer and drawer guides attached to a bottom of said table top above said cantilever support brace for slidably supporting the vanity drawer.

8. The overbed table as set forth in claim 7, including a detent mechanism for releasably positioning said vanity drawer under said table top.

9. The overbed table as set forth in claim 8, wherein said detent mechanism is a spring-loaded ball and a recess for receiving said ball.

10. The overbed table as set forth in claim 1, including a pivotally mounted second table top attached to the bottom of said table top which can be swung outwardly from under said table top.

11. The overbed table comprising:

a base member;

an adjustable vertical column extending upwardly from one end of said base member;

a table top attached at one end to an adjustable end of said adjustable vertical column and including a remote end extending outwardly therefrom;

a cantilever support brace spaced below the one end of the table top extending outwardly from said adjustable vertical column and upwardly to support the remote end of said table top; and a pair of spaced drawer guides attached to a bottom of said table top between the one end and the remote end of the table top and a lower table top slidably supported by said drawer guides.

12. The overbed table as set forth in claim 11, including a pair of spaced drawer guides attached to the bottom of said lower table top and a vanity drawer slidably supported by said drawer guides below said lower table top.

13. An overbed table comprising:

a base assembly;

a vertical column on one end of said base assembly;

a cantilever support brace extending outwardly from said vertical column and upwardly with a distal end of said support brace being substantially even with a top of said vertical column;

a first flange on said vertical column and a second flange on the distal end of said support brace;

a plurality of spaced vertical axles disposed on each of said first and second flanges;

a driving wheel rotatably mounted on each of said vertical axles;

a first table top in driving contact with said driving wheels;

a second table top overlying said first table top and said driving wheels and having a driven member mounted on the bottom at each end thereof, each of said driven members having opposed edges configured to interact with said driving wheels whereby movement of either said first or second table tops in a first direction will cause the other table top to move in a second direction opposite to said first direction.

14. The overbed table as set forth in claim 13, wherein said driving wheels have an inwardly curved circumferential recess.

15. The overbed table as set forth in claim 13, wherein said first table top and said driven members on said second table top have edges configured to interact with said driving wheels.

16. The overbed table as set forth in claim 13, wherein said cantilever support brace extends outwardly from said vertical column substantially parallel to said table tops and then upwardly to support remote ends of said first and second table tops.

17. The overbed table as set forth in claim 13, wherein said vertical column and said support brace form an extended U-shaped support for said table tops.

18. The overbed table as set forth in claim 13, including a vanity drawer slidably mounted on the bottom of said first table top above said cantilever support brace.

19. A bidirectional table top comprising:

a plurality of spaced axles;

a driving wheel rotatably supported on each of said axles, each of said driving wheels having a surface configured to support a table top;

a first table top having opposite edges configured to cooperate with said driving wheels to support said first table top;

a second table top overlying said first table top and said driving wheels; and a pair of driven members for said second table top disposed on a bottom of said second table top near each end thereof, each of said driven members having an opposed edge configured to cooperate with said driving wheels to support and frictionally move said second table top.

20. The bidirectional table top as set forth in claim 19, wherein said first table top is supported on one side of said driving wheels and said support members for said second table top are supported on the opposite side of said driving wheels so that movement of said first table top in a first direction will cause said second table top to move in a direction opposite to said first direction.

21. An overbed table comprising:

a base member;

a vertically adjustable column on said base member;

a cantilever support brace attached to said vertically adjustable column near a remote end of said column, said support brace extending away from said column and upwardly so that the remote end of said support brace is even with a top of said column;

a first flange member disposed on the top of said column;

a second flange member disposed on an end of said support brace, said second flange member being oriented parallel to said first flange member;

a vertical axle mounted on each of said elongated flange members;

a driving wheel rotatably mounted on each of said vertical axles;

a first table top positioned between each of said driving wheels; and a second table top overlying said first table top and each of said driving wheels, said second table top being operatively coupled to the side of said driving wheels opposite to the side contacting said first table top so that motion of either table top in a first direction will cause the other table top to move in a second opposite direction.

22. The overbed table as set forth in claim 21, wherein said driving wheels are configured to cooperate with the edges on said first and second table tops to frictionally drive said table tops in opposite directions.

* * * * *

UNITED STATES PATENT AND TRADEMARK OFFICE

CERTIFICATE OF CORRECTION

PATENT NO. : 5,473,997

DATED : December 12, 1995

INVENTOR(S) : Robert A. Solomon et al.

It is certified that error appears in the above-indentified patent and that said Letters Patent is hereby corrected as shown below:

Column 2, line 26;
"," should be --;--.

Column 2, line 31;
"cross sectional" should be --cross-sectional--.

Column 2, line 37;
"cross sectional" should be --cross-sectional--.

Column 4, line 39;
"tile" should be --the--.

Column 5, line 51;
"illustrate" should be --illustrated--.

UNITED STATES PATENT AND TRADEMARK OFFICE

CERTIFICATE OF CORRECTION

PATENT NO. : 5,473,997

DATED : December 12, 1995

INVENTOR(S) : Robert A. Solomon et al.

It is certified that error appears in the above-indentified patent and that said Letters Patent is hereby corrected as shown below:

Column 5, line 52;
"73" should be --73'--.

Column 5, line 57;
"extrusion the" should be--extrusion. The--.

Column 5, line 65;
"same this" should be --same. This--.

Column 6, line 14;
"(79") notably" should be --(79"). Notably--.

Column 6, line 17;
"123 ad 125" should be --123 and 125--.

Abstract, Line 3;
"mourned" should be --mounted--.

Signed and Sealed this

Second Day of July, 1996

Bruce Lehman

*Attest:*

BRUCE LEHMAN

*Attesting Officer*

*Commissioner of Patents and Trademarks*